US006296001B1

(12) United States Patent
Lin et al.

(10) Patent No.: US 6,296,001 B1
(45) Date of Patent: Oct. 2, 2001

(54) RIB ASSEMBLY FOR MULTIPLE-FOLD UMBRELLA HAVING PLASTIC INTERMEDIATE RIB INTERCONNECTED AMONG LIGHT RIBS

(75) Inventors: Chung-Kuang Lin; Jung-Jen Chang, both of Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 09/507,892

(22) Filed: Feb. 22, 2000

(51) Int. Cl.[7] ..... A45B 25/00
(52) U.S. Cl. ..... 135/31; 135/25.1
(58) Field of Search ..... 135/16, 29, 30, 135/31, 32, 37; 403/375, 326

(56) References Cited

U.S. PATENT DOCUMENTS 5,931,175 * 8/1999 Lin et al. ..... 135/31
6,035,873 * 3/2000 Lin et al. ..... 135/25.1

* cited by examiner

*Primary Examiner*—Carl D. Friedman
*Assistant Examiner*—Steve Varner
(74) *Attorney, Agent, or Firm*—Dougherty & Troxell

(57) ABSTRACT

A rib assembly for multiple-fold umbrella includes: an aluminum top rib pivotally secured to an upper notch formed on a top portion of a central shaft, an aluminum stretcher rib pivotally connected between the top rib and a lower runner slidably held on the central shaft, a plastic intermediate rib interconnected between the top rib and an aluminum or plastic outer rib, an aluminum connecting rib pivotally connected between the stretcher rib and the intermediate rib, and a spring rib slidably coupled to the intermediate rib by a ring member fastened on the intermediate rib; with the plastic intermediate rib interconnected among those light ribs for strengthening the rib assembly substantially made of light-weight materials.

8 Claims, 5 Drawing Sheets

RIB ASSEMBLY FOR MULTIPLE-FOLD UMBRELLA HAVING PLASTIC INTERMEDIATE RIB INTERCONNECTED AMONG LIGHT RIBS

BACKGROUND OF THE INVENTION

For making multiple-fold umbrella, the weight of the rib assembly is expected to be decreased as much as possible. If all ribs of the rib assembly are made of aluminum alloy, the umbrella weight can be greatly reduced. However, the aluminum rib may be easily deformed or broken when subjected to strong wind.

U.S. Pat. No. 5,931,175 to the same inventors of this application disclosed a top rib (1) made of light materials including aluminum alloy and an outer rib (2) made of composite or plastic materials for forming a rib assembly especially adapted for making a single-fold umbrella. However, it did not disclose a rib assembly for making triple fold or multiple-fold umbrella.

The present inventor has found the drawbacks of the prior arts and invented the present rib assembly for multiple-fold umbrella having a plastic intermediate rib interconnected among other light ribs.

SUMMARY OF THE INVENTION

The object of the present invention is to provide a rib assembly for multiple-fold umbrella including: an aluminum top rib pivotally secured to an upper notch formed on a top portion of a central shaft, an aluminum stretcher rib pivotally connected between the top rib and a lower runner slidably held on the central shaft, a plastic intermediate rib interconnected between the top rib and an aluminum or plastic outer rib, an aluminum connecting rib pivotally connected between the stretcher rib and the intermediate rib, and a spring rib slidably coupled to the intermediate rib by a ring member fastened on the intermediate rib; with the plastic intermediate rib interconnected among those light ribs for strengthening the rib assembly substantially made of light-weight materials.

DETAILED DESCRIPTION

Figure 1:
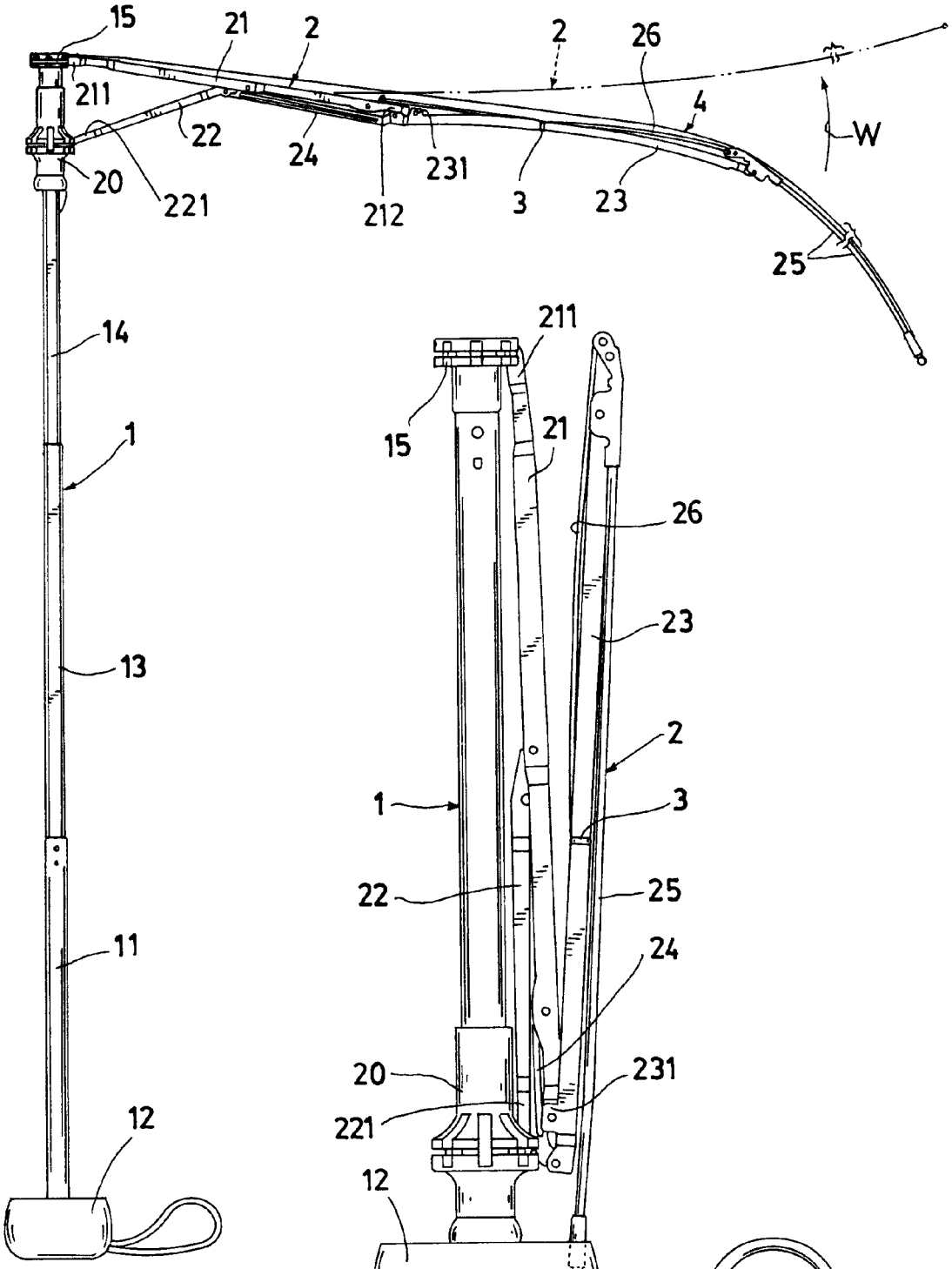
FIG. 1 is an illustration showing an opening umbrella of the present invention.
Figure 2:
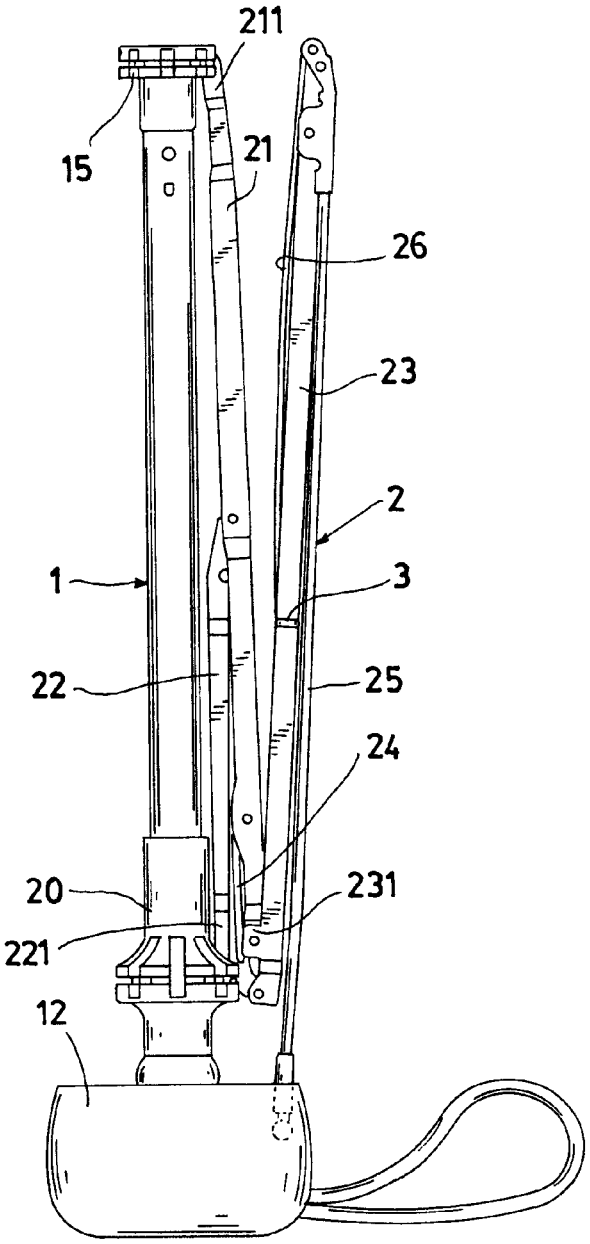
FIG. 2 shows a folded umbrella of the present invention.
Figure 3:
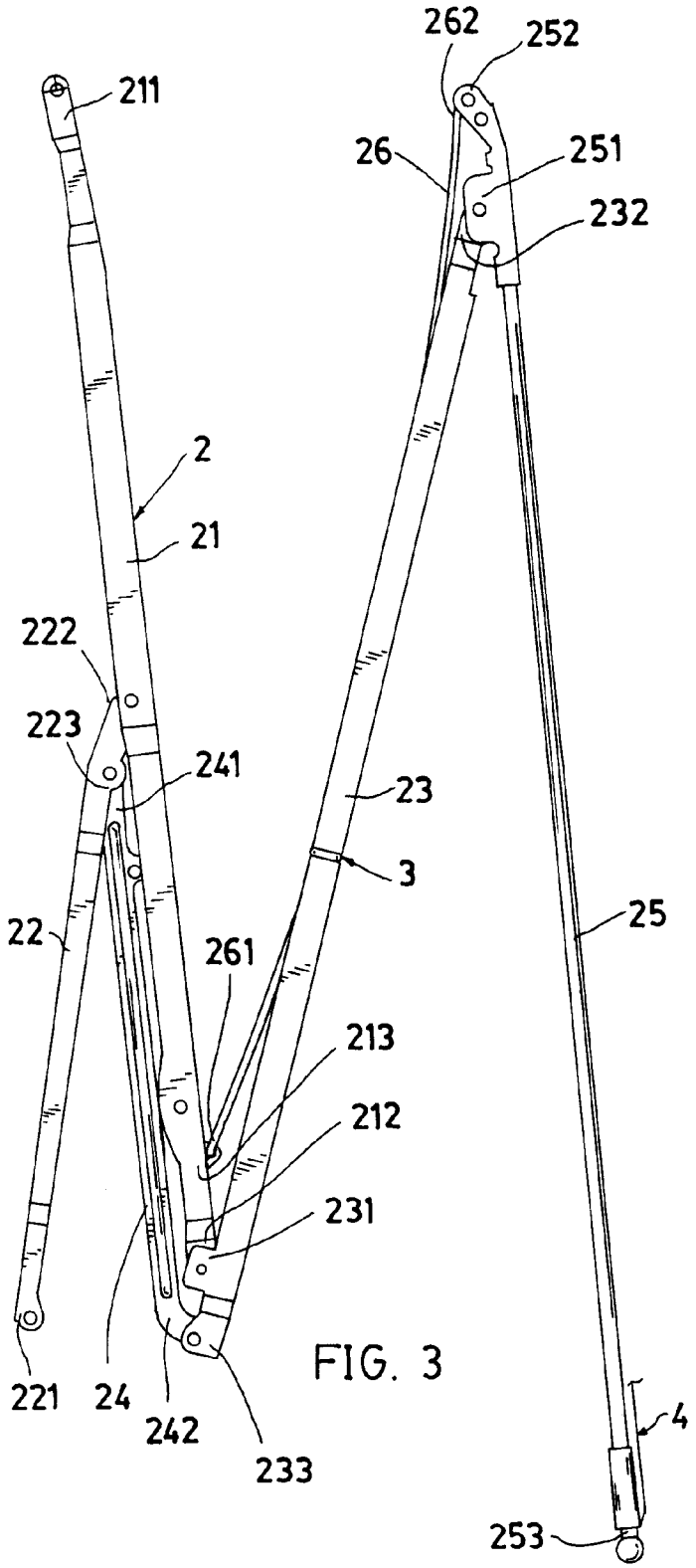
FIG. 3 is a perspective view showing the folding step of the present invention.
Figure 4:
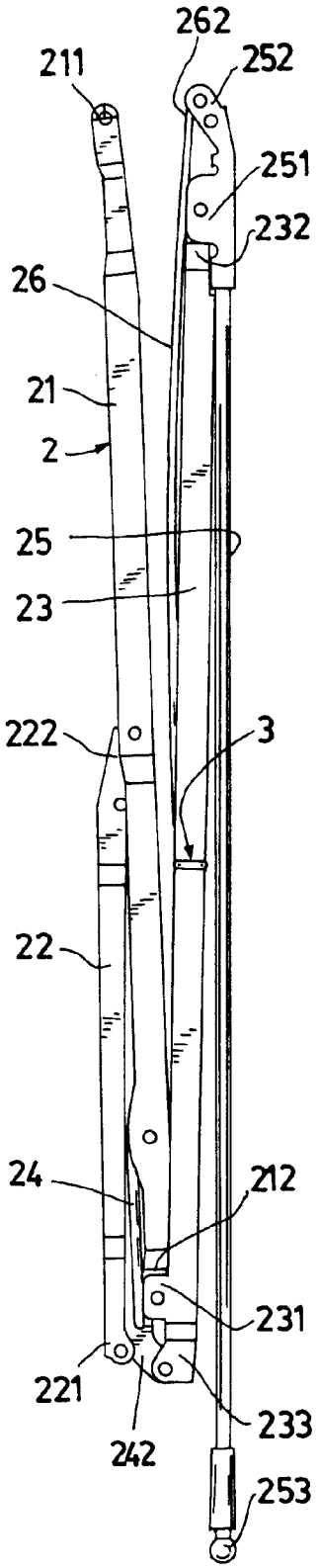
FIG. 4 is an illustration of the present invention when completely folded from FIG. 3.

As shown in FIGS. 1–7, the rib assembly 2 of the present invention comprises: a top rib 21 having its inner portion 211 pivotally secured to an upper notch 15 formed on a top portion of the central shaft 1; a stretcher rib 22 having an inner portion 221 thereof pivotally secured to a lower runner 20 slidably held on the central shaft 1 and having an outermost end 222 of the stretcher rib 22 pivotally connected to a middle portion of the top rib 21; an intermediate rib 23 having an inner portion 231 thereof pivotally connected with an outermost end 212 of the top rib 21; a connecting rib 24 having an inner portion 241 thereof pivotally connected with an outer portion 223 of the stretcher rib 22 adjacent to the outermost end 222 of the stretcher rib 22, and having an outer portion 242 of the connecting rib 24 pivotally connected to an innermost end 233 of the intermediate rib 23 adjacent to the inner portion 231 of the intermediate rib 23; an outer rib 25 having an inner portion 251 thereof pivotally connected with an outer portion 232 of the intermediate rib 23, and having an outer portion 253 of the outer rib 25 secured with a ball tip for securing an umbrella cloth 4 on the outer portion 253 of the outer rib (with the cloth 4 also secured to the upper notch 15 of the shaft 1); and a spring rib 26 having an inner portion 261 thereof pivotally secured to an outer portion 213 of the top rib 21 adjacent to the outermost end 212 of the top rib 21, and having an outer portion 262 of the spring rib 26 pivotally connected to an innermost end 252 of the outer rib 25.

The inner portion 251 and the innermost end 252 of the outer rib 25 may be formed as a joint member for respectively pivotally connecting the intermediate rib 23 and the spring rib 26.

The connecting rib 24 may be formed as an elongate strip having reinforced ribs integrally formed theron. the central shaft 1 includes: a lower tube 11 having a grip 12 secured thereunder, a middle tube 13, and a upper tube 14 telescopically engageable with one another; with the upper notch 15 formed on a top of the upper tube 14.

The spring rib 26 may be formed with metallic wire or rod including steel wire or rod having suitable resilience, passing through a ring member 3 fastened on a middle portion of the intermediate rib 23 for slidably coupling the spring rib 26 in a groove longitudinally formed in the intermediate rib 23.

All the ribs in construction of the rib assembly 2 of the present invention may be made of light materials including aluminum alloy, except the intermediate rib 23 and the spring rib 26.

Figure 5:
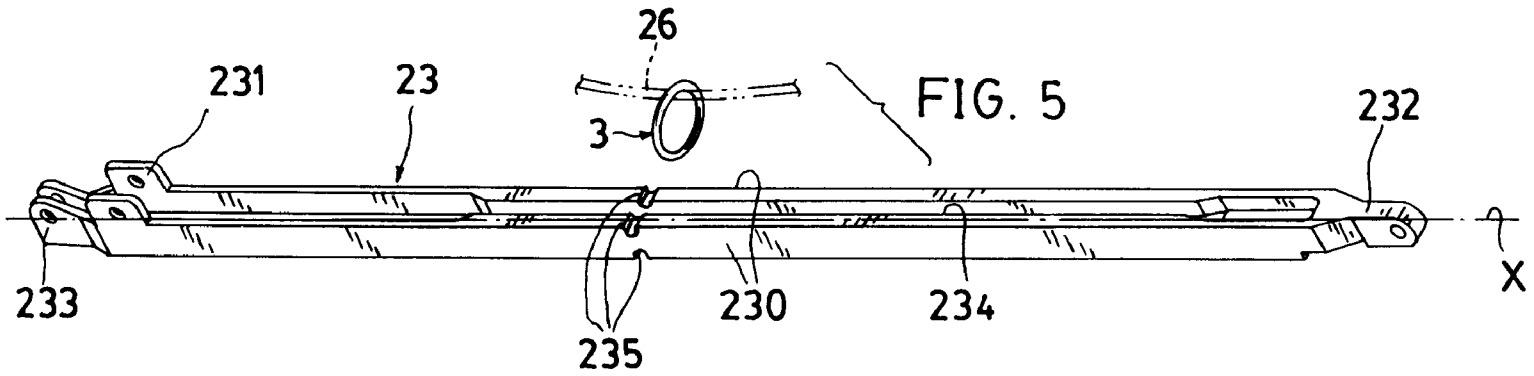
FIG. 5 is an exploded view of the intermediate rib, the ring member and the spring rib of the present invention.
Figure 6:
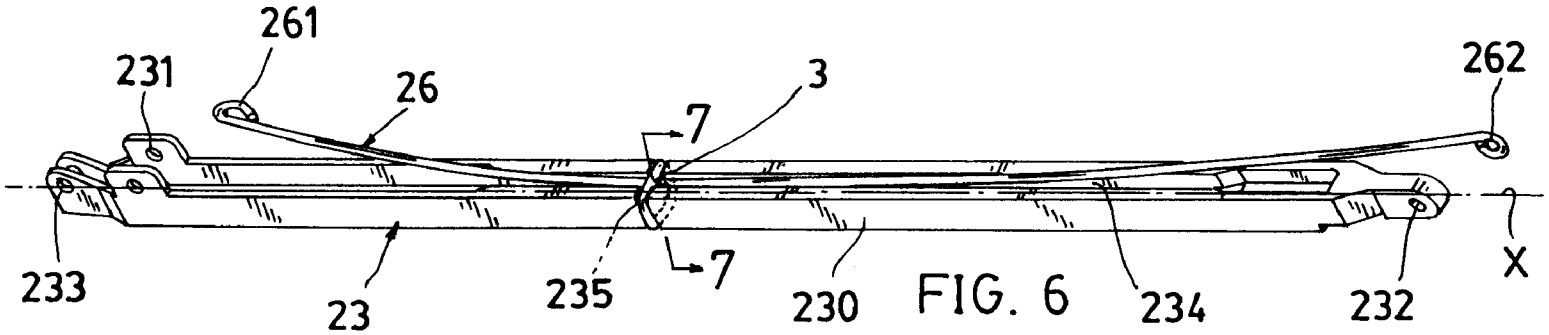
FIG. 6 is an illustration of the present invention when assembled from FIG. 5.
Figure 7:
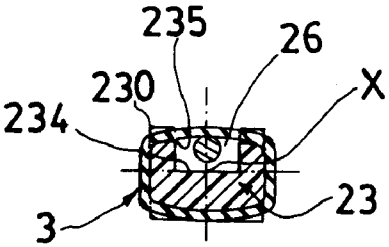
FIG. 7 is a cross-sectional drawing of the present invention when viewed from 1—7 direction of FIG. 6.

The intermediate rib 23 as shown in FIGS. 5~7 includes: a longitudinal groove 234 longitudinally recessed in a first surface (or an upper surface when the umbrella is opened) of the intermediate rib 23 for slidably coupling the spring rib 26 within the longitudinal groove 234, a pair of side walls 230 respectively disposed on opposite sides of the longitudinal groove 234, and an annular groove 235 circumferentially recessed in a circumference of the intermediate rib 23 including the two side walls 230 and a second surface (or bottom surface) of the intermediate rib 23 opposite to the first surface about a longitudinal axis X defined at a longitudinal center of the intermediate rib 23.

The ring member 3 is resiliently engaged with the annular groove 235 recessed in the intermediate rib 23 to be projectively perpendicular to the longitudinal axis X of the intermediate rib 23.

The intermediate rib 23 is made of materials having durable strength for resisting deformation, twisting, bending or breaking of the rib 23, including: plastic material, reinforced plastic material, engineering plastic material, and composite reinforced with plastic material in the composite. The grooves 234, 235 may be formed by plastic molding processes.

The ring member 3 is preferably made of elastomers including: plastic, rubber materials having suitable elasticity and wear resistance in order to be resiliently firmly fastened on the intermediate rib 23 especially wound into the annular groove 235 recessed in the intermediate rib 23. Other materials including metal or alloy may still be used in this invention.

The ring member 3 is firmly fastened on the (middle portion of) intermediate rib 23 because the rib 23 has a frictional surface disposed around the circumference of the rib 23 to frictionally hold the ring member 3 on the frictional surface of the rib 23 for preventing loosening or withdrawal of the ring member 3 from the rib 23 for stably coupling the spring rib 26 with the intermediate rib 23.

The plastic intermediate rib 23 is interconnected among the other ribs of the rib assembly 2 made of aluminum alloy or other light materials for strengthening the wind resistance (W) of the ribs 2 as shown in FIG. 1 when opening the umbrella for preventing deformation or breakage of the ribs.

Since the plastic intermediate rib 23 merely "occupies" a small proportion of the ribs of the rib assembly 2 based on weight and volume, the ribs as substantially made of aluminum alloy are still light in weight, but without impairing their strength of an opening umbrella especially when subjected to strong wind.

So, the present invention discloses the plastic intermediate rib 23 among other ribs substantially made of aluminum to render the multiple-fold umbrella (including triple fold and plural folds) with light weight and proper strength durable for strong wind blowing, thereby being convenient for handling or storage and being reliable for uses.

For considering the resilience of the outer rib 25, the rib 25 may also be made of resilient plastic material. Since the outer rib 25 is generally formed as a fine round rod, its influence to the total weight of the rib assembly can be neglected.

Figure 8:
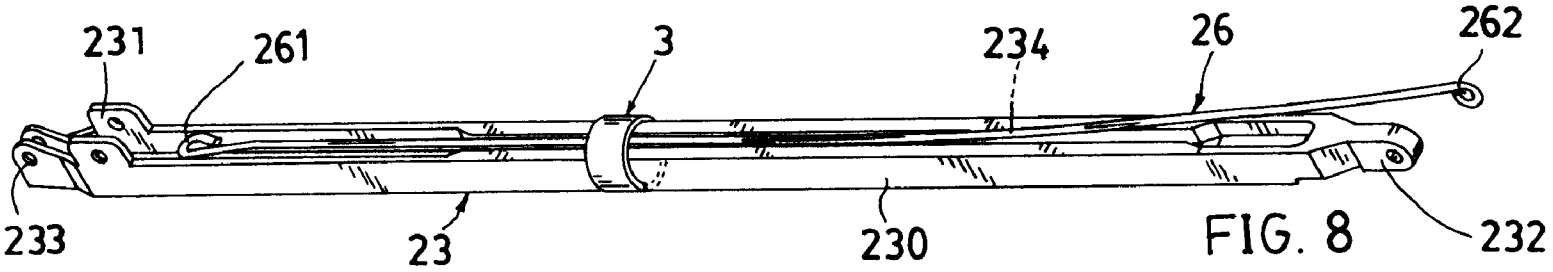
FIG. 8 shows another preferred embodiment of the present invention.

As shown in FIG. 8, the ring member 3 of the present invention may be formed as a cylindrical shape by increasing the length of the ring member 3 (from FIG. 5 to FIG. 8) to be firmly fastened on the intermediate rib 23 for passing the spring rib 26 within the ring member 3 for slidably holding the spring rib 26 within the longitudinal groove 234 recessed in the intermediate rib 23.

Figure 9:
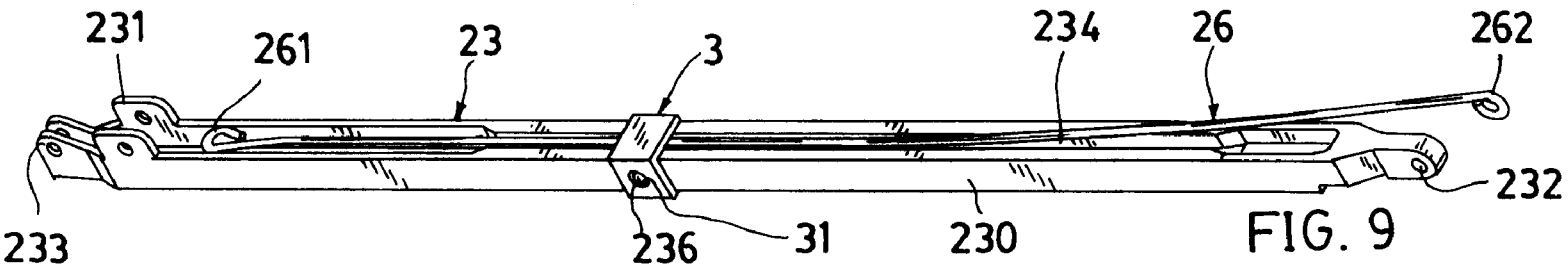
FIG. 9 shows still another preferred embodiment of the present invention.

As shown in FIG. 9, the side wall 230 of the intermediate rib 23 is formed with at least a protrusion 236 for engaging a cavity 31 as recessed or formed in the ring member 3 for fastening the ring member 3 on a middle portion of the intermediate rib 23.

The intermediate rib 23 has a cross section formed as U shape, H shape or any other shapes, not limited in the present invention. As shown in FIGS. 10~14, the intermediate rib 23 is formed to have a cross section of H shape, including a longitudinal groove 234 longitudinally recessed in a first surface of the intermediate rib 23 and a bottom groove 234*a* longitudinally recessed in a second (or bottom) surface of the intermediate rib 23. The H-shaped rib 23 will render a better structural strength for resisting deformation or breakage of the rib 23.

The ring member 3 is preferably made of elastomers, but may also be made of other materials including metal or metal alloys. The annular groove 235 as shown in FIG. 5 may also be omitted if the ring member 3 can be firmly fastened on the rib 23.

Figure 10:
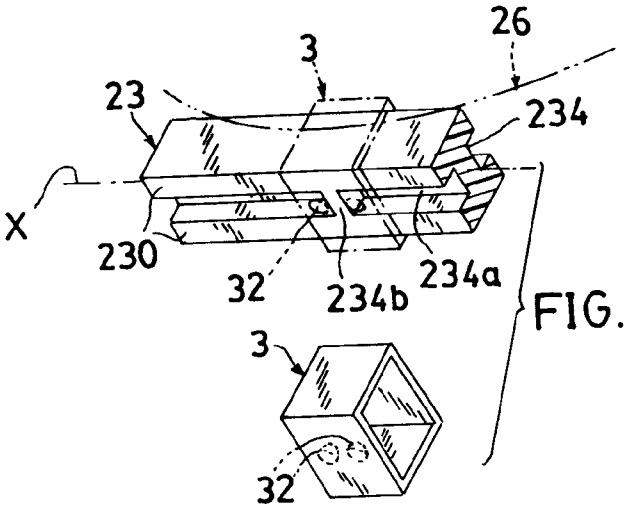
FIG. 10 shows further preferred embodiment of the present invention.

As shown in FIG. 10, the intermediate rib 23 further includes: a diaphragm extension 234*b* transversely formed in the bottom groove 234*a*, and the ring member 3 has a pair of bottom protrusions 32 formed on a bottom inside wall of the ring member 3 for frictionally clamping the diaphragm extension 234*b* formed on the bottom surface of the rib 23 for firmly fastening the ring member 3 on the intermediate rib 23 for passing the spring rib 26 within the ring member 3 for slidably coupling the spring rib 26 with the intermediate rib 23.

Figure 11:
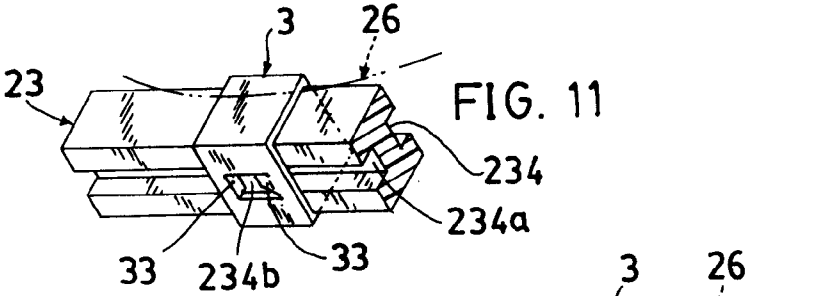
FIG. 11 shows still further preferred embodiment of the present invention.

An shown in FIG. 11, the ring member 3 includes a pair of lugs 33 pressed inwardly or protruding centripetally towards the longitudinal axis X of the rib 23 for clamping the diaphragm extension 234*b* transversely formed on the bottom surface of the rib 23 for fastening the ring member 3 on the rib 23.

Figure 12:
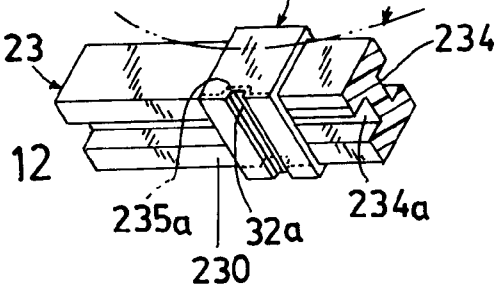
FIG. 12 shows another modification for fastening the ring member on the intermediate rib of the present invention.

As shown in FIG. 12, the ring member 3 is formed with a transverse extension 32*a* on a bottom portion of the ring member 3 for engaging a bottom recess 235*a* transversely recessed in the bottom portion of the intermediate rib 23 for fastening the ring ember 3 on the rib 23.

Figure 13:
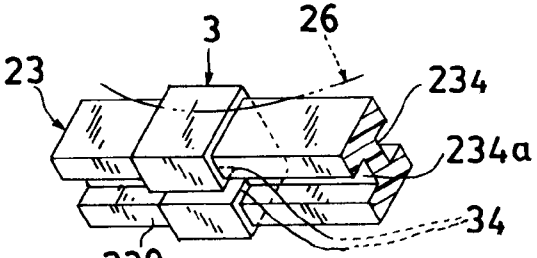
FIG. 13 shows still another modification for fastening the ring member on the intermediate rib of the present invention.

As shown in FIG. 13, the ring member 3 includes a pair of clamping hooks 34 formed on opposite bottom portions of the ring member 3 for respectively clamping two side walls 230 (bottom portions of the side walls) of the intermediate rib 23 for fastening the ring member 3 on the rib 23.

Figure 14:
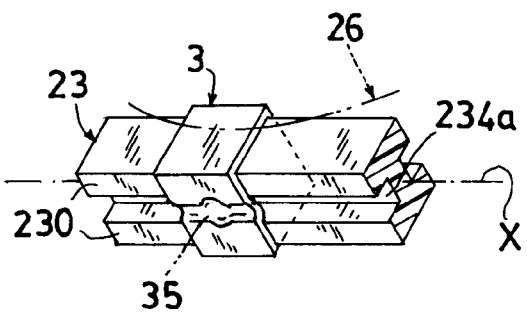
FIG. 14 shows further modification for fastening the ring member on the intermediate rib of the present invention.

As shown in FIG. 14, the ring member 3 is made of metal or alloy and is directly pressed in a bottom central portion of the ring member 3 to form a "pressing" portion 35 pressed inwardly towards the longitudinal axis X of the rib 23 to tightly squeeze the bottom central portion of the ring member 3 into the bottom groove 234*a* of the intermediate rib 23 for firmly fastening the ring member 3 on the rib 23.

The present invention may be further modified without departing from the spirit and scope of the present invention.

What is claimed is:

1. A rib assembly for multiple-fold umbrella comprising:

a top rib pivotally secured to an upper notch formed on a top portion of a central shaft;

a stretcher rib pivotally connected between the top rib and a lower runner slidably held on said central shaft;

an intermediate rib having a cross section of H shape and pivotally connected to said top rib;

a connecting rib pivotally connected between said stretcher rib and said intermediate rib;

an outer rib pivotally secured to said intermediate rib; and a spring rib made of light-weight materials including plastic and aluminum alloy and pivotally connected between said top rib and said outer rib, said spring rib slidably coupled with said intermediate rib by a ring member, with said ring member fastened on said intermediate rib for passing said spring rib through said ring member;

each said top rib, said stretcher rib and said connecting rib made of aluminum alloy;

the improvement which comprises:

said intermediate rib made of materials capable for resisting deformation, bending and twisting, including plastic, engineering plastic, and reinforced plastic material, and composite reinforced with plastic material; said ring member firmly fastened on said intermediate rib for passing said spring rib within said ring member for slidably coupling said spring rib to said intermediate rib.

2. A rib assembly according to claim 1, wherein said ring member has a cross section formed as circular, square and rectangular shape to be engaged with a ring groove circumferentially recessed in said intermediate rib about a longitudinal axis defined at a longitudinal center of said intermediate rib.

3. A rib assembly according to claim 1, wherein said intermediate rib includes a diaphragm extension transversely formed in a bottom groove longitudinally recessed in a bottom portion of said intermediate rib; and said ring member having a pair of bottom protrusions formed on a bottom portion of said ring member for clamping said diaphragm extension of said intermediate rib for fastening said ring member on said intermediate rib.

4. A rib assembly according to claim 1, wherein said ring member includes a pair of lugs formed on a bottom portion of said ring member for clamping a diaphragm extension transversely formed on a bottom portion of said intermediate rib for fastening said ring member on said intermediate rib.

5. A rib assembly according to claim 1, wherein said ring member is formed with a transverse extension on a bottom portion of said ring member for engaging a bottom recess transversely recessed in a bottom portion of said intermediate rib for fastening said ring member on said intermediate rib.

6. A rib assembly according to claim 1, wherein said ring member includes a pair of clamping hooks formed on opposite bottom portions of said ring member for respectively clamping two side walls of said intermediate rib for fastening said ring member on said intermediate rib.

7. A rib assembly according to claim 1, wherein said ring member is fastened on said intermediate rib by inwardly pressing a bottom portion of said ring member into a bottom groove in said intermediate rib for fastening said ring member on said intermediate rib.

8. A rib assembly according to claim 1, wherein said ring member is made of plastic and metal materials.

* * * * *